US006986648B2

(12) United States Patent
Williams et al.

(10) Patent No.: US 6,986,648 B2
(45) Date of Patent: Jan. 17, 2006

(54) ELECTRIC PUMP

(75) Inventors: David John Williams, Warwick (GB); David Thomas Black, Birmingham (GB)

(73) Assignee: Dana Automotive Limited (GB)

( * ) Notice: Subject to any disclaimer, the term of this patent is extended or adjusted under 35 U.S.C. 154(b) by 278 days.

(21) Appl. No.: 10/428,290

(22) Filed: May 2, 2003

(65) Prior Publication Data

US 2004/0028539 A1 Feb. 12, 2004

(30) Foreign Application Priority Data

May 9, 2002 (GB) ..... 0210544

(51) Int. Cl.
*F04B 17/03* (2006.01)

(52) U.S. Cl. ..... 417/370; 417/423.8

(58) Field of Classification Search ..... 417/366, 417/369, 370, 423.8

See application file for complete search history.

(56) References Cited

U.S. PATENT DOCUMENTS

| | | | | |
|---|---|---|---|---|
| 2,734,459 A | | 2/1956 | Zimsky | |
| 3,426,691 A | * | 2/1969 | Anderson | 417/370 |
| 4,834,624 A | * | 5/1989 | Jensen et al. | 417/370 |
| 5,332,369 A | * | 7/1994 | Jensen | 417/369 |
| 5,997,261 A | * | 12/1999 | Kershaw et al. | 417/366 |
| 6,200,108 B1 | * | 3/2001 | Caudill et al. | 417/370 |

FOREIGN PATENT DOCUMENTS

| | | |
|---|---|---|
| DE | 199 48 972 A1 | 4/2001 |
| EP | 0768592 | 4/1997 |
| EP | 0831236 | 3/1998 |
| EP | 0913910 | 5/1999 |
| EP | 0 990 800 A1 | 4/2000 |
| EP | 1124302 | 8/2001 |
| FR | 2 008 305 | 1/1970 |
| JP | 2002130190 | 5/2002 |
| WO | WO 01/94783 | 12/2001 |

OTHER PUBLICATIONS

European Search Report.

* cited by examiner

*Primary Examiner*—Michael Koczo, Jr.
(74) *Attorney, Agent, or Firm*—Dykema Gossett PLLC

(57) ABSTRACT

A pump including an electric motor mounted in a motor casing, and a rotatable pumping member, the pumping member when rotated by the motor pumping a first fluid, there being a first fluid flow path for the first fluid from a high pressure side of the pumping member, into the motor casing to cool the motor, and to a low pressure side of the pumping member, the pump further including a heat exchanger located between a wall of the motor casing and a heat load, the heat exchanger including a second fluid flow path for a second fluid so that in use, heat is exchanged between the first and second fluids.

10 Claims, 2 Drawing Sheets

ELECTRIC PUMP

This application claims priority to United Kingdom Patent Application No. 0210544.3 filed May 9, 2002, the entire disclosure of which is incorporated herein by reference.

FIELD OF THE INVENTION

The present invention relates to an electric pump, particularly, but not exclusively, to an electric pump for pumping coolant around an automotive engine.

DESCRIPTION OF PRIOR ART

It is known to use pumped fluid to cool a motor of an electric pump. For example, it is known to divert a portion of pumped fluid from a high pressure region of a pump impeller chamber, through laminations of the motor stator, into the motor rotor chamber, and back to a low pressure region of the impeller chamber. Flow of the pumped fluid around such a path is driven by the pressure difference between the fluid in different portions of the pressure impeller chamber. Where the electric motor is for example, a brushless DC motor such as a switched reluctance motor, or other motor in which electronic components used to control the motor, such components may also be positioned adjacent the flow path of the diverted pumped fluid so that the electronics are also cooled.

In alternative arrangements, it is known to provide a cooling jacket around the motor, through which an external coolant, other than the pumped fluid, may flow.

SUMMARY OF INVENTION

According to a first aspect of the present invention we provide a pump including an electric motor mounted in a motor casing, and a rotatable pumping member, the pumping member when rotated by the motor pumping a first fluid, there being a first fluid flow path for the first fluid from a high pressure side of the pumping member, into the motor casing to cool the motor, and to a low pressure side of the pumping member, the pump further including a heat exchanger located between a wall of the motor casing and a heat load, the heat exchanger including a second fluid flow path for a second fluid so that in use, heat is exchanged between the first and second fluids.

Thus, by virtue of the invention, more efficient cooling of the motor and the heat load can be achieved than would be possible by using either pumped fluid or an eternal fluid alone.

Typically the heat load is provided by electronic components used for controlling the motor. This electric motor may be a brushless DC motor which includes electronic components necessary for motor control, which produce heat.

The first fluid flow path may pass through laminations of a motor stator, and farther preferably, around a motor rotor.

The pump may flier include a filter adapted to filter the first fluid as it passes along the first fluid flow path. Such a filter may, for example, be a centrifugal filter which may be integral with or mounted on a common shaft with the motor rotor.

According to a second aspect of the invention, we provide an engine cooling system including a pump adapted to pump a-first cooling fluid around the engine, the pump including an electric motor mounted in a motor casing, and a rotatable pumping member, the pumping member when rotated by the motor pumping the first cooling fluid, there being a first fluid flow path for the first cooling fluid from a high pressure side of the pumping member, through the motor casing to cool the motor, and to a low pressure side of the pumping member, the pump further including a heat exchanger located between a wall of the motor casing and a heat load, the heat exchanger including a second fluid flow path for a second cooling fluid so that in use, heat is exchanged between the first and second fluids.

Preferably, either the first cooling fluid, or the second cooling fluid is engine oil. Thus, during warming-up of the engine, the temperature of the engine oil may be increased towards a desired operating temperature more rapidly, due to transfer of heat to the oil from the motor. In this case, the other of the first or second cooling fluid may be a water-based coolant,

DESCRIPTION OF THE DRAWINGS

The invention will now be described, by way of example only, with reference to the accompanying drawings of which.

DESCRIPTION OF PREFERRED EMBODIMENTS OF THE INVENTION

Figure 1:
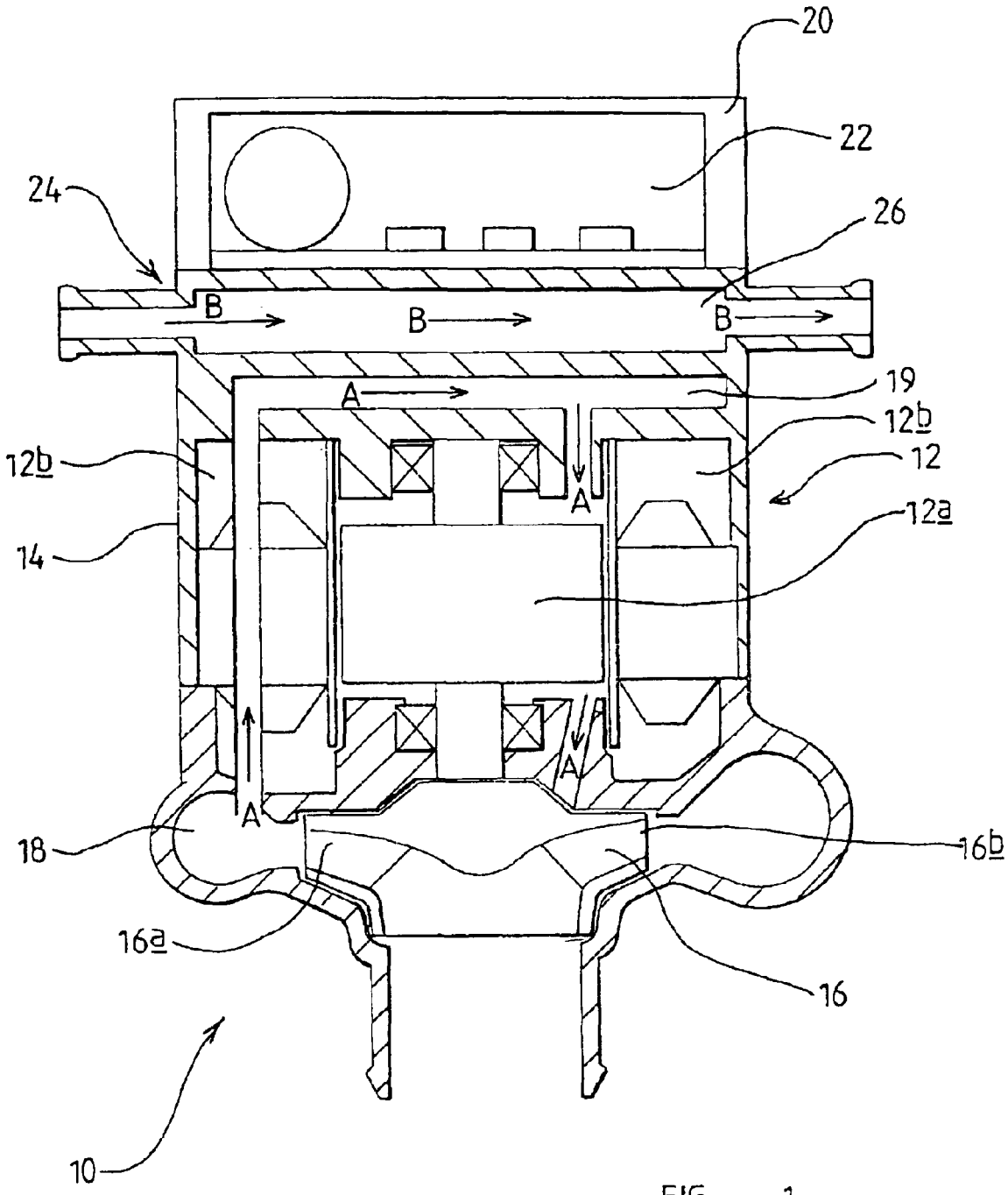
FIG. 1 is an illustration of a pump according to the first aspect of the invention.

Referring now to the figure, there is shown a pump 10 including an electric motor 12 mounted inside a motor casing 14. The motor 12 in this example is a brushless DC motor with a rotor 12*a* mounted for rotation inside a generally annular stator 12*b*. The pump 10 further includes a rotatable pumping member which in this case is an impeller 16 which is mounted in an impeller chamber 18 and is connected to the rotor 12*a* such that in use it is rotated by the motor 12 to pump a first cooling fluid.

A first fluid flow path A is provided from a high pressure side 16*a* of the impeller 16 to a low pressure side 16*b* of the impeller, such that a portion of the first cooling fluid is, in use, forced around the first fluid flow path A by virtue of the difference in pressure between the two ends of the first fluid flow path A. The first fluid flow path A extends from the high pressure side 16*a* along a passage provided in the stator 12*b* such that laminations of the stator 12*b* are cooled by the first cooling fluid. The first cooling fluid then enters a generally disc shaped chamber 19 located at an opposite end of the motor 12 to the impeller 16, from where it passes around the rotor 12*a* to cool the rotor 12*a*, and out to the low pressure side 16*b* of the impeller 16.

The pump 10 further includes a heat load, which is a housing 20 containing electrical/electronic control components 22 adapted to control operation of the motor 12. The housing 20 is located at the end of the motor 12 opposite to the impeller 16, and there is a second fluid flow path B passing between the motor casing 14 and the housing 20. In use, a second cooling fluid passes along the second fluid flow path B, which acts as a heat exchanger, heat being transferred between the second cooling fluid and the control components 22.

The second fluid flow path B is also adjacent to the disc-shaped chamber 19 provided in the motor casing 14 as part of the first fluid flow path A. Heat may thus also be transferred between the first and the second cooling fluids.

Figure 2:
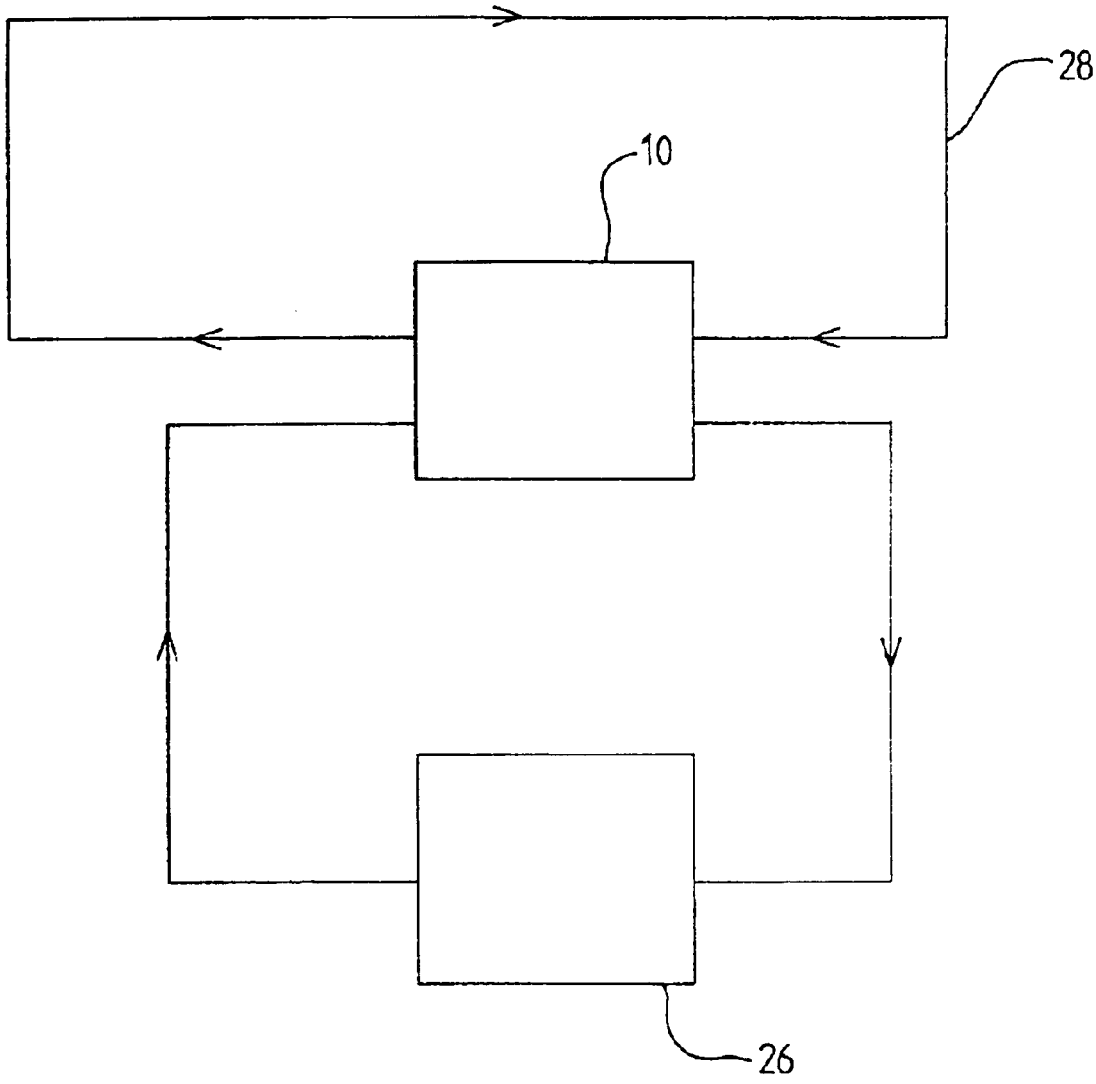
FIG. 2 is a schematic illustration of an engine cooling system according to the second aspect of this invention.

Thus, in use, the first cooling fluid cools the motor rotor 12*a* and stator 12*b*, and the second cooling fluid cools the motor control components 22. In addition, if the first cooling fluid is cooler than the second, the first cooling fluid also acts to cool the second, or vice versa By virtue of the use of two cooling fluids, efficient cooling of the pump 10 is achieved. Moreover, by virtue of the integration of the heat exchanger with the pump 10, a particularly compact arrangement of heat exchanger and pump motor 12 cooling system is achieved, A pump 10 according to the invention, may be used in an engine cooling system as illustrated in FIG. 2. The first cooling fluid may, for example, be engine oil, being pumped by the impeller 16 around an engine 26, and the second cooling fluid may be water or a water-based coolant which passes around a separate coolant circuit 28, or vice versa. This has an additional advantage that whilst the engine 26 is warming up, the engine oil is warmed either by the motor rotor 12*a* and stator 12*b*, or by the motor control components 20, and thus the engine oil may reach its optimum operating temperature more rapidly than it would otherwise.

The pump 10 may also be provided with a filter which is adapted to filter the first cooling fluid as it passes along the first fluid flow path A. For example, the filter may be a centrifugal filter which is integral with or mounted on a common shaft with the motor rotor 12*a*, such that rotation of the rotor causes rotation of the filter. Magnetic components of the motor 12 may also act to trap and remove metallic particles from the first cooling fluid, which is particularly advantageous if the first cooling fluid is engine oil.

It will be appreciated that the embodiment described above is given by way of example only, and various modifications may be made within the scope of the invention.

The pump 10 need not include an impeller 16. It may instead be provided with a gear, gerotor, screw, vane or any other rotatable pumping member.

The first fluid flow path need not be exactly as shown in the figure. For example, the first fluid flow path need not pass through the laminations of the stator 12*b*, and the first cooling fluid may flow only between the stator 12*b* and rotor 12*a* and around the rotor 12*a*.

The motor 12 could be of the kind in which the rotor 12*a* is arranged around a central stator 12*b*.

What is claimed is:

1. A pump including an electric motor mounted in a motor casing, and a rotatable pumping member the pumping member when rotated by the motor pumping a first fluid, there being a first fluid flow path for the first fluid from a high pressure side of the pumping member, into the motor casing to cool the motor, and to a low pressure side of the pumping member, the pump further including a heat exchanger located between a wall of the motor casing and a heat load, the heat exchanger including a second fluid flow path for a second fluid so that in use, heat is exchanged between the first and second fluids.

2. A pump according to claim 1, wherein the heat load is provided by electronic components for controlling the motor.

3. A pump according to claim 2, wherein the electric motor is a brushless DC motor.

4. A pump according to claim 1, wherein the first fluid-flow path passes through laminations of a motor stator.

5. A pump according to claim 1, wherein the first fluid flow path passes around a motor rotor.

6. A pump according to claim 1 further including a filter adapted to filter the first fluid as it passes along the first fluid flow path.

7. A pump according to claim 6 wherein the filter is a centrifugal filter which is integral with or mounted on a common shaft with the motor rotor.

8. An engine cooling system including a pump adapted to pump a first cooling fluid around the engine, the pump including an electric motor mounted in a motor casing, and a rotatable pumping member, the pumping member when rotated by the motor pumping the first cooling fluid, there being a first fluid flow path for the first cooling fluid from a high pressure side of the pumping member, through the motor casino to cool the motor, and to a low pressure side of the pumping member, the cooling system further including a heat exchanger located between a wall of the motor casing and a heat load, the heat exchanger including a second fluid flow path for a second cooling fluid so that in use, heat is exchanged between the first and second fluids.

9. An engine cooling system according to claim 8, wherein the first cooling fluid, or the second cooling fluid is engine oil.

10. An engine cooling system according to claim 9, wherein the other of the first or second cooling fluid is a water-based coolant.

* * * * *